United States Patent [19]

Babler

[11] 4,079,828

[45] Mar. 21, 1978

[54] APPARATUS FOR CONTROLLING THE BI-DIRECTIONAL TRANSPORT OF A FLEXIBLE WEB

[75] Inventor: Egon S. Babler, Northbrook, Ill.

[73] Assignee: Teletype Corporation, Skokie, Ill.

[21] Appl. No.: 717,299

[22] Filed: Aug. 24, 1976

[51] Int. Cl.[2] ..... B41J 33/40

[52] U.S. Cl. ..... 197/160; 197/162; 242/67.4; 74/710.5; 74/770

[58] Field of Search ..... 197/151, 153 R, 160, 197/161, 162, 163, 164, 165; 101/336; 74/377, 378, 379, 710, 710.5, 711, 713, 714; 242/67 A

[56] References Cited

U.S. PATENT DOCUMENTS

| | | | |
|---|---|---|---|
| 960,804 | 6/1910 | Brand | 197/160 |
| 1,075,996 | 10/1913 | Stickney | 197/162 |
| 2,132,692 | 10/1938 | Lawrence | 74/710.5 |
| 2,300,755 | 11/1942 | Williams | 101/336 X |
| 2,542,917 | 2/1951 | Fischer et al. | 74/710.5 X |
| 2,693,871 | 11/1954 | Stahl et al. | 197/162 |
| 2,800,990 | 7/1957 | Williams | 197/162 |
| 2,902,135 | 9/1959 | Sparks | 197/153 R |
| 2,999,397 | 9/1961 | Walter | 74/377 |
| 3,056,314 | 10/1962 | Eichler et al. | 74/770 |
| 3,554,349 | 1/1971 | Hebert | 197/160 X |
| 3,602,356 | 8/1971 | Dodsworth | 197/162 |
| 3,670,981 | 6/1972 | Cavella | 242/67.4 |
| 3,825,103 | 7/1974 | Riley | 197/164 |

*Primary Examiner*—Ernest T. Wright, Jr.
*Attorney, Agent, or Firm*—W. K. Serp; J. C. Albrecht

[57] ABSTRACT

Unidirectional driving torque is applied to the inputs of first and second differential gears. Each differential gear includes an output blocking gear as well as a spool output gear coupled to a spool with a ribbon web transported between the spools. A locking gear alternately engages the blocking gears and is held in position by a detent mechanism which yieldably restrains rotation of the locking gear. Each of the spool output gears are provided with unidirectional brakes. The restrained blocking gear selects the differential gear through which the input drive is transferred to its respective spool. A web tension condition causes the restrained blocking gear to rotate the locking gear against the detent and the locking gear increments to its alternate position with the previous supply spool becoming the take-up spool.

15 Claims, 7 Drawing Figures

FIG. 1
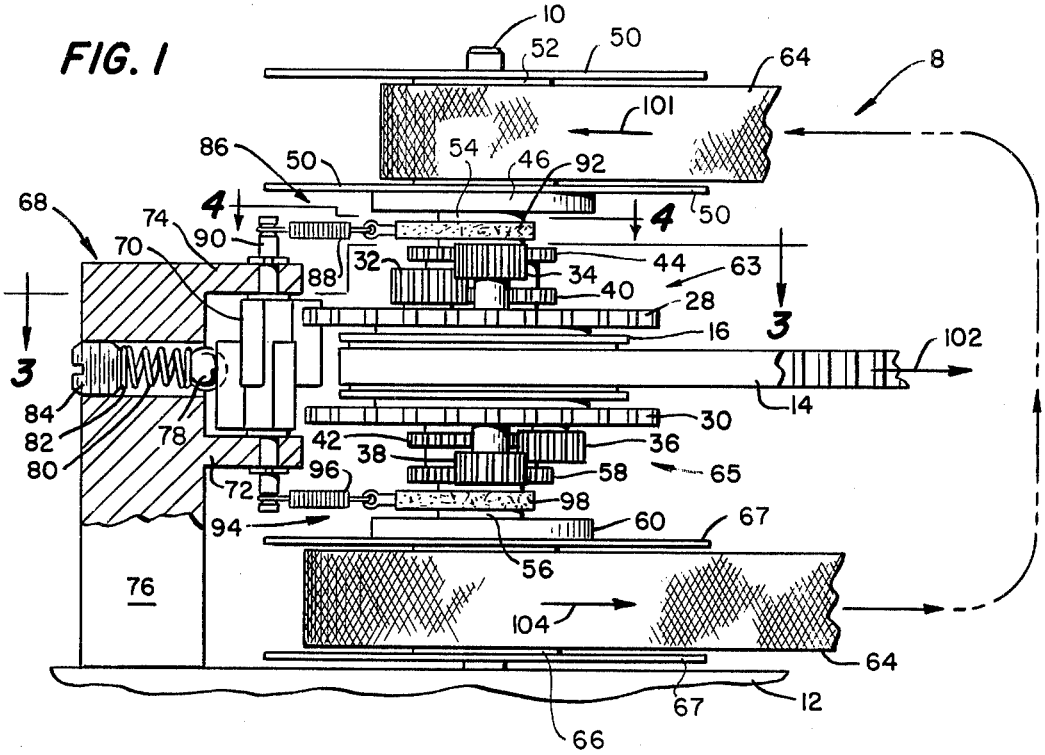
FIG. 2
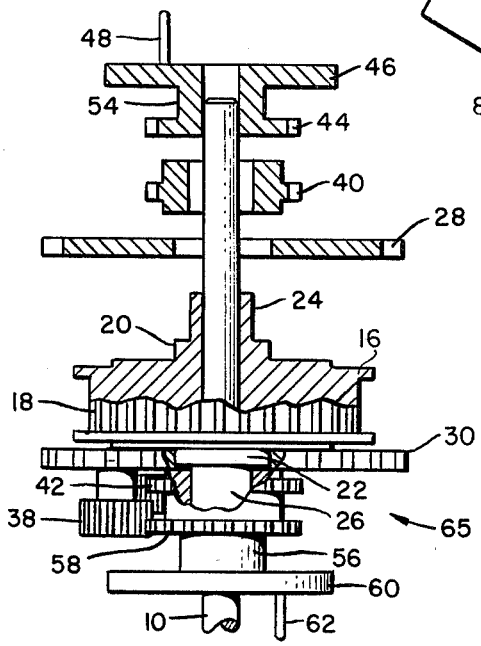
FIG. 3
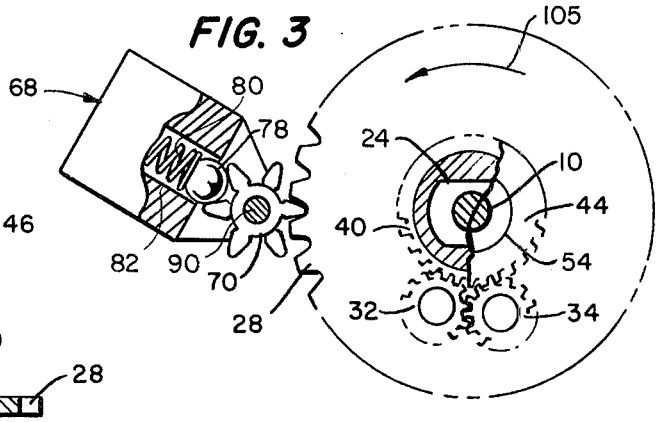
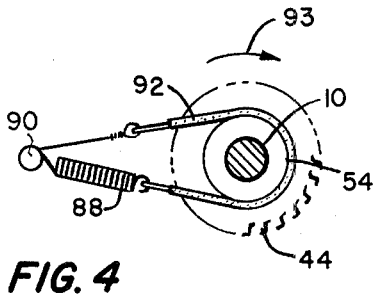
FIG. 4

FIG. 5
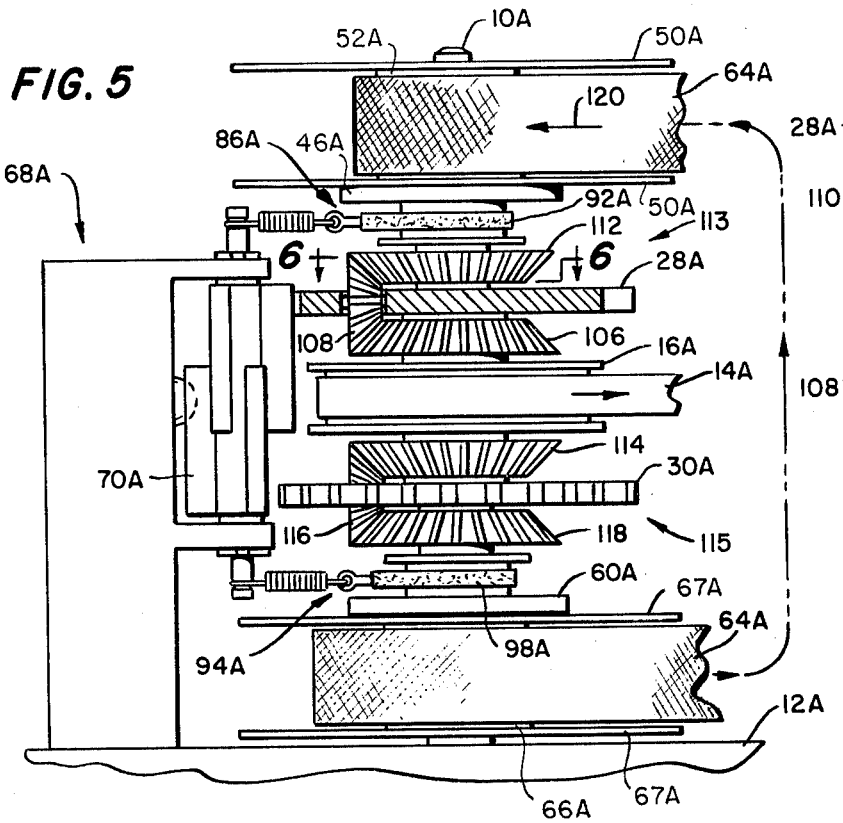
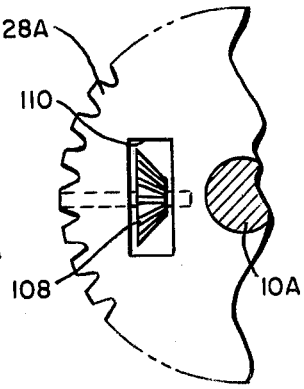
FIG. 6
FIG. 7
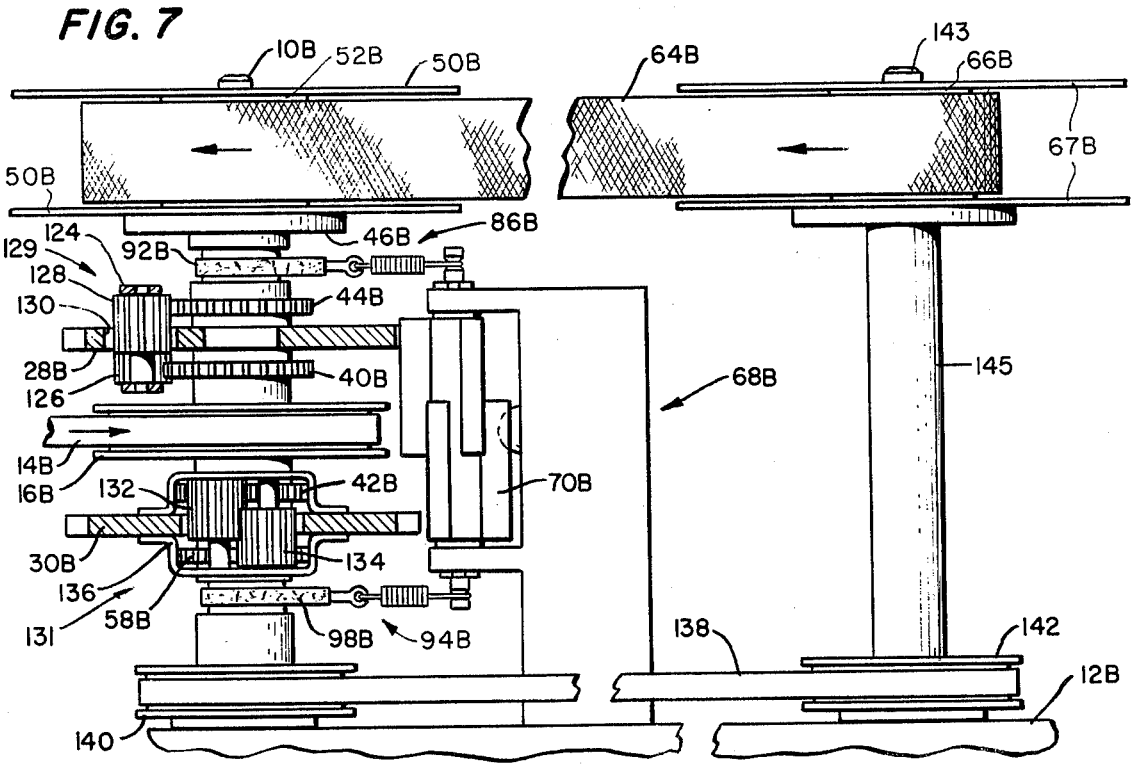

APPARATUS FOR CONTROLLING THE BI-DIRECTIONAL TRANSPORT OF A FLEXIBLE WEB

BACKGROUND

This invention generally relates to an apparatus for controlling the transport of a flexible web between a pair of spatially positioned spools and more particularly relates to such a mechanism which incorporates a self-reversing mechanism actuated when the web tension exceeds a predetermined amount.

Communication printers generally include ink ribbon devices for continually advancing the ribbon during printing. Continual movement of the ribbon distributes the ink usage over the entire ribbon thus greatly increasing ribbon life while improving the quality and clarity of the copy. It is conventional to draw the ribbon from a supply spool to a takeup until the ribbon in the supply spool is exhausted. The direction of ribbon feed is thereafter reversed and the original take-up spool becomes the supply spool.

Various types of ribbon drive mechanisms which include tension control reversing features are well-known. One particular device is described in U.S. Pat. No. 3,670,981 entitled "Self-Reversing Ribbon Drive" issued June 20, 1972 to J. J. Cavella. Cavella utilizes a pair of web-bearing spools which are alternately driven in opposite directions by a driver gear. The mechanism is shiftable between respective positions whereat the driver gear is drivingly coupled to one of the spools and then, in response to a predetermined ribbon tension, the alternate spool serves as the takeup spool thus reversing the direction of movement of the ribbon. To effectively eliminate the condition wherein the driving mechanism is lodged in an indeterminate position, mechanical biasing means in the form of magnets are utilized to assure that at least one of the spools is functioning as a motor driven take-up spool. The Cavella arrangement necessarily results in a rather complicated and relatively large mechanism and does not lend itself readily to use in compact printer assemblies which may be desired for mobile installations. Various other forms of ribbon reversal mechanisms have been described to accomplish the reversing by means of switches, relays or solenoids including a variety of various mechanical linkages. Many such arrangements have been proven to be costly, complicated, and relatively unreliable.

With respect to the illustrated embodiment, the ribbon is transferred from a supply spool to a take-up spool. In response to a tensioning condition of the ribbon occasioned by exhaustion of the ribbon from the supply spool or the presence of an undesirable jam condition, a shifting mechanism is actuated which reverses the drive to the spools and thus the direction of ribbon movement. Serving to prevent the mechanism from accidentally lodging in an intermediate position wherein neither of the two spools act as the take-up spool, the embodiment includes a detent mechanism which assures positive transfer of the driving force from one spool to the other upon sensing of a ribbon tension condition. As illustrated, the embodiment provides a unique and improved means for a ribbon reversing mechanism which is compact allowing its utilization in relatively small printer assemblies. Although the following description concerns transport of an ink ribbon, the principles of the invention are applicable to apparatus for handling other forms of flexible web.

SUMMARY

An apparatus for controlling the transport of a flexible web between a first spool and a second spool spacially displaced from the first spool. The apparatus includes a source of input drive and a first differential gear having the input thereof coupled to the input drive source. The first differential gear also includes a spool drive output coupled to the first spool and a selectively restrainable second output. A second differential gear is included with the input coupled to the input drive source and a spool drive output coupled to the second spool. The second differential gear also includes a selectively restrainable second output. Selectively actuable means are included for alternately restraining the second output of the first differential gear or the second output of the second differential gear so that the position of the restraining means determines which of the spools is driven by the input drive source.

Preferably, the second output of the first differential gear includes a blocking gear and the second output of the second differential gear also includes a blocking gear. The selectively actuable restraining means alternately engages the blocking gears and means responsive to the force exerted on the restraining means by the engaged blocking gear are actuated for momentarily releasing the restraining means to allow engagement of the restraining means with the alternate blocking gear.

The restraining means include a locking gear defining a plurality of alternately axially offset teeth with alternate teeth being positioned for selective engagement with alternate blocking gears and the releasing means including a detent mechanism engaging the locking gear and maintaining the locking gear in engagement with a selected blocking gear until a predetermined rotational force is transmitted to the locking gear through the restrained blocking gear whereupon the detent mechanism allows the locking gear to increment to an alternate position.

In a preferred embodiment, a first unidirectional brake retards rotation of the first spool in the rotational direction opposite to the direction imparted by the input drive source and a second unidirectional brake retards the spool output of the second differential gear and is operative to retard movement of the second spool when serving as the supply spool.

It is a main object of this invention to provide a ribbon handling mechanism which automatically reverses ribbon direction in response to increased ribbon tension and which displays a relatively compact structure. Other objects and advantages of this invention will become obvious from the following description of a preferred embodiment thereof when considered in conjunction with the accompanying drawing.

BRIEF DESCRIPTION OF THE DRAWING

FIG. 1 is a partially sectionalized plan view of a ribbon handling mechanism including certain features of this invention.

FIG. 2 is a partially sectionalized, partially exploded, view of selected components of the apparatus illustrated in FIG. 1.

FIG. 3 is a sectional view taken along the line 3—3 of FIG. 1.

FIG. 4 is a sectional view of a component of the apparatus of FIG. 1 taken along the line 4—4.

FIG. 5 is a plan view of a ribbon drive and reversing mechanism illustrating an alternate embodiment of this invention.

FIG. 6 is a fragmentary view taken along the line 6—6 of FIG. 5 illustrating certain components of the embodiment of FIG. 5; and FIG. 7 is a plan view of a ribbon drive and reversing mechanism illustrating still another embodiment of this invention.

DETAILED DESCRIPTION

PREFERRED EMBODIMENT

With reference to FIG. 1, the component parts of a ribbon drive and reversing mechanism 8 are mounted upon a vertically oriented main support shaft 10, one end of which is secured to a printer main frame 12. Serving to impart driving movement to the mechanism 8 by means of a motor (not shown), through a drive belt 14, is a motor drive gear 16 freely journalled about the main support shaft 10. With particular reference to FIG. 2, the outer surface of the gear 16 defines a plurality of equally spaced, axially oriented ridges 18 which engage a mating surface on the drive belt 14 so as to produce a nonslip drive between the motor (not shown) and the mechanism 8. Axially extending from gear 16 are upper and lower cylindrical hubs 20 and 22, and extending from each of the hubs 20 and 22 are respectively upper and lower keyed projections 24 and 26. Freely positioned for rotation about the hubs 20 and 22 are upper and lower blocking gears 28 and 30. Carried on the upper blocking gear 28 (FIG. 1) are a pair of offset, intermeshing pinion gears 32 and 34. Similarly carried on the lower blocking gear 30 are a pair of offset intermeshing pinion gears 36 and 38. Serving to transfer rotary motion from the motor gear 16 to the upper pinion gears 32 and 34 is an upper input drive gear 40 which is keyed to the projection 24 of the motor gear 16 for rotation therewith about the shaft 10. Similarly, transferring rotational movement to the lower pinion gears 36 and 38 is a lower input drive gear 42 which is keyed to the projection 26 for rotation with the motor gear 16. It will be noted that each of the input drive gears 40 and 42 meshes with only one of the pinion gears 32 and 36. That is, drive gear 40 meshes with pinion gear 32 and drive gear 42 with pinion gear 36.

With reference to FIG. 2, the upper pinion gear 34 engages a spool drive gear 44 carrying a spool support platform 46 from which projects a pin 48 positively engaging the ribbon spool 52. Formed between the upper spool drive gear 44 and the upper support platform 46 is an upper friction brake drum 54. Similarly a lower friction brake drum 56 is located between a lower spool drive gear 58 which engages pinion gear 38 and a lower spool support platform 60 carrying a pin 62 which engages a lower spool 66.

It will be appreciated that when the motor gear 16 is driven, both of the input drive gears 40 and 42, which are keyed to the motor gear 16, rotate. The upper input gear 40 and cooperating pinion gears 32 and 34 as well as the upper blocking gear 28 and upper spool drive gear 44 comprise what may be termed an epicyclic or planetary gear train in the form of a differential gear 63. That is, rotational torque applied to the upper input gear 40 is transferred to either the blocking gear 28 or the spool drive gear 44 depending upon which of the gears 28 or 44 experiences the greater restraining force. When the upper blocking gear 28 is restrained the upper ribbon spool 52 will rotate and when the spool platform 46 is restrained as a result of ribbon 64 tension, the upper blocking gear 28 will increment as will subsequently be considered. Similarly, the lower input drive gear 42 and cooperating pinion gears 36 and 38 together with the lower blocking gear 30 and spool gear 58 comprise a lower differential gear 65. The construction of the ribbon spool 52 and the lower spool 66 are conventional and each respectively include outwardly projecting flanges 50 and 67. Each of the spools 52 and 66 define at least one hole for engagement with their respective drive pins 48 and 62 thus assuring rotation with their respective spool platforms 46 and 60. The ribbon 64 is wrapped about the central hub of each spool 52, 66 with the ends of the ribbon 64 securely fastened to their respective spools 52, 66 to prevent removal upon completion of the ribbon 64 transfer from one spool to the other.

Serving to alternately lock the blocking gears 28 and 30 is a detent mechanism 68 including a locking gear 70 particularly illustrated in FIG. 3. Alternate teeth of the locking gear 70 are axially offset so that the locking gear 70 is positioned in engagement with only one of the blocking gears 28, 30 at a time. Serving to support the locking gear 70 for rotation about an axis parallel to the support shaft 10 are a pair of spaced support arms 72 and 74 which project from an upwright detent support pedestal 76 mounted upon the main printer frame 12. Yieldably restraining the locking gear 70 is a ball 78, biased by means of a captive coil spring 80 toward the locking gear 70. The ball 78 and spring 80 combination are retained within a round hole 82 bored through the detent support pedestal 76. The force exerted by the ball 78 upon the locking gear 70 is adjustable by a cap screw 84 threaded into one end of the hole 82. As illustrated in FIG. 1, alternate teeth of the locking gear 70 overlap at the location of the ball 78 and the ball 78 is seated between adjacent teeth of the gear 70. Rotation of the locking gear 70 is restrained by the detent mechanism 68 until a sufficient torque is reached at which point the ball 78 yields allowing the locking gear 70 for rotatably increment.

Serving to control the rate of ribbon feed from the upper spool 52, when the spool 52 acts as the ribbon supply source, is a unidirectional brake 86 which includes a coil spring 88 secured to the support axle 90 of the locking gear 70 with the remaining end of the spring 88 secured to a brake band 92 constructed of fibrous material. The band 92 is wrapped about the upper brake drum 54 as illustrated in FIG. 4. When the upper spool 52 is serving as the supply spool and rotating in the direction of the arrow 93 (FIG. 4), the brake 86 is effective to retard rotation of the upper ribbon spool 52. Conversely, when the spool 52 is driven by the input gear 40 with the blocking gear 28 restrained by the locking gear 70, the brake spring 88 allows the brake band 92 to slip about the upper brake drum 54. Similarly, the lower spool differential gear 65 is provided with a unidirectional brake 94 which includes a coil spring 96 and a brake band 98 secured to the free end of the coil spring 96 and wrapped about a brake drum 56. The remaining end of the brake band 98 and the spring 96 are secured to the locking gear axle 90.

For purposes of discussion it will be assumed that the ribbon 64 is being transported in the direction of the arrow 101 indicated in FIG. 1; the upper spool 52 functioning as the take-up spool and the lower spool 66 being the supply spool. The belt 14 is driven in the direction indicated by the arrow 102 with the upper blocking gear 28 restrained by the locking gear 70. Since the blocking gear 28 is restrained, the input drive is transmitted through the upper pinion gears 32 and 34 to the spool drive gear 44 causing the spool 52 to rotate in the direction indicated by the arrow 101. This direction is against the retarding action of the unidirectional brake 86 thus allowing slippage between the upper brake drum 54 and cooperating brake band 92. It will be appreciated that the lower blocking gear 30 is not engaged by the locking gear 70 and is therefore free to rotate. The rotational force exerted by the ribbon 64 as it is payed from the spool 66 causes the spool 66 to turn in the direction of the arrow 104. Therefore, the torque transmitted through the lower blocking gear 30 causes it to rotate. As the ribbon 64 is payed out from the lower ribbon spool 66, the ribbon support platform 60 and friction brake drum 56 rotate in the direction against the retarding force of the brake band 98 and the brake 94 prevents overrun of the spool 66.

Upon total pay-out of the ribbon 64 from the lower supply spool 66, further rotation of the upper supply spool 52 is restrained due to the fact that the end of the ribbon 64 is permanently attached to the spool 66. Since the input torque applied to the upper differential gear 63 is prevented from turning the upper spool 52, torque is applied to the upper blocking gear 28 forcing it to rotate in the direction of the arrow 105 (FIG. 3) causing the detent mechanism 68 to yield and the blocking gear 28 to rotate. As the blocking gear 28 rotates, the detent ball 78 is forced into the detent pedestal 76 and the locking gear 78 rotationally increments, freeing the upper blocking gear 28 and simultaneously engaging the lower blocking gear 30. The input drive from the motor gear 16 is transferred to the lower ribbon spool 66 which now serves as the take-up spool reversing the direction of ribbon movement. It will be appreciated that the direction of ribbon movement is reversed since the upper and lower differential gears 63 and 65 are similar and on opposite sides of the gear 16. Thus, when the ribbon 64 has been fully taken up on the spool 52, the tension exerted by the ribbon 64 on the spool 52 produces an automatic reversal in the drive of the two spools 52, 66 and the ribbon 64 reverses its direction.

First Alternate Embodiment

With respect to FIG. 5, an alternate ribbon drive arrangement is illustrated wherein those components corresponding in operation and function to those of the embodiment of FIG. 1 are provided with the same numeral designation followed by the suffix A. Keyed to the motor gear 16A for rotation therewith is an upper input bevel gear 106 which engages a freely rotating idler gear 108 positioned in a rectangular output 110 in the upper blocking gear 28A. The upper idler gear 108 engages an upper spool drive bevel gear 112 with the combination comprising a differential gear 113. Input to the upper differential gear 113 is directed to either the blocking gear 28A or the spool drive gear 112 depending upon which of these gears 28A, 112 is experiencing the greater restraint. Similarly, a lower differential gear 115 arrangement includes a lower input bevel gear 114 engaging an idler gear 116 mounted in a rectangular cutout defined by the lower blocking gear 30A. Engaged with the idler gear 116 is a lower spool drive gear 118 and carried thereon is the lower ribbon spool platform 60A. The apparatus additionally includes unidirectional brakes 86A and 94A associated with each of the ribbon platforms 46A and 60A and operating in a manner similar to that of the embodiment of FIG. 1. Additionally, a locking gear 70A, alternately engages the blocking gears 28A and 30A and is yieldably restrained by a detent mechanism 68A.

For purposes of discussion it is assumed that the lower spool 66A is the supply spool with the upper spool 52A functioning as the take-up spool. In this condition, the upper blocking gear 28A is engaged by the locking gear 70A so that input torque is transmitted through the idler bevel gear 108 to the upper spool gear 112 causing the upper spool 52A to rotate in the direction indicated by the arrow 120 winding the ribbon 64A thereabout. With the upper blocking gear 28A engaged by the locking gear 70A, the lower blocking gear 30A is free to rotate. The lower ribbon spool 66A is free to move with respect to the drive mechanisms and thus supplies the ribbon 64A upon demand. The lower unidirectional brake 94A assembly serves to prevent overrun of the spool 66A and which could cause the fouling of the ribbon 64A. When the ribbon 64A has been fully payed from the lower supply spool 66A, ribbon tension increases, resisting rotational movement of the upper ribbon spool 52A. The drive torque to the upper input gear 106 is transmitted to the blocking gear 28A causing it to turn the locking gear 70A against the detent mechanism 68A and the locking gear 70A increments to its alternate position. In the alternate position, the blocking gear 30A is locked and the lower spool 66A serves as the take-up spool with the upper spool 52A being the supply spool.

Second Alternate Embodiment

With respect to FIG. 7 still another embodiment is illustrated utilizing an alternate form of differential gear as well as an alternate arrangement for ribbon spool drive. As illustrated in FIG. 7, those components which are similar in both operation and construction to the components of the embodiment of FIG. 1 are indicated by the same reference numeral together with the subscript B. Rotational torque is transmitted through the motor gear 16B to an upper input gear 40B which is keyed to the motor gear 16B for rotation therewith. Maintained within a housing 124 are a pair of axially offset pinion gears 126 and 128, which are positioned within a rectangular opening 130 defined by the upper blocking gear 28B. The housing 124 within which the pinion gears 126 and 128 are located is mounted upon the blocking gear 28B. As mentioned, the pinion gear 126 is axially offset from and in engagement with the pinion gear 128 and the upper input drive gear 40B. The pinion gear 128 engages the upper spool drive gear 44B. The combination of the pinion gears 126 and 128 and the drive gears 40B and 44B form a differential gear 129. Thus, it will be appreciated that when the upper blocking gear 28B is restrained, torque applied to the upper input gear 40B will drive the spool gear 44B and conversely when the upper ribbon spool 52B is restrained by the ribbon 64B, a substantial rotational torque will be applied to the blocking gear 28B. A lower differential gear 131 is similarly constructed and includes a pair of axially offset pinion gears 132 and 134 within a housing 136 secured to the lower blocking gear 30B. Serving to alternately lock either the upper or lower blocking gear 28B or 30B is a locking gear 70B which functions in a manner similar to that previously described in connection with the embodiments of FIGS. 1 and 5. Rather than mounting a lower spool support platform directly to the lower spool drive gear 58B as in the previous embodiments, this embodiment includes a belt 138 coupled between a first pulley 140 spaced from a second pulley 142 and mounted for rotation about a support post 143 having an axis parallel to the axis of the support shaft 10B. It will be appreciated that rotational torque applied to the first ribbon pulley 140 is transmitted to the second pulley 142 which is coupled to the ribbon spool 66B by a sleeve 145. The function of the pulleys 140 and 142 is to allow offsetting of the two spools 52B and 66B whereas in the previous embodiments the spools 52, 66, and 52A, 66A rotate on a common axis with the ribbons 64 and 64A following a "U" shaped path.

Driving torque is transferred to the upper drive spool 52B with the upper blocking gear 28B restrained and the remaining spool 66B serving as the ribbon supply spool. The operation and construction of the upper and lower unidirectional brake assemblies 86B and 94B as well as the detent assembly 68B are similar to those described in connection with the previous embodiments.

Although this invention has been particularly shown and described with reference to a preferred and two alternate embodiments thereof, it will be understood that various changes in form and detail may be made without departing from the spirit and scope of the invention as set forth in the following claims.

What is claimed is:

1. An apparatus for controlling the transport of a flexible web between a first spool and a second spool spacially displaced from said first spool comprising:

a source of input drive, a first differential gear having the input thereof coupled to said input drive source, said first differential gear including a spool drive output coupled to said first spool and a selectively restrainable second output, a second differential gear having the input thereof coupled to said input drive source, said second differential gear including a spool drive output coupled to said second spool and a selectively restrainable second output; and selectively actuable means having alternate positions for restraining said second output of said first differential gear or said second output of said second differential gear whereby the position of said restraining means determines which of said spools is driven by said input drive source with the non-driven spool serving as a supply spool for the web.

2. The apparatus of claim 1 wherein said second output of said first differential gear includes a first blocking gear and said second output of said second differential gear includes a second blocking gear, said selectively actuable restraining means alternately engaging said first and second blocking gears, and means responsive to a predetermined rotational force exerted upon said restraining means by the engaged blocking gear for releasing said restraining means which then engages the alternate blocking gear.

3. The apparatus of claim 2 wherein said restraining means includes a locking gear defining a plurality of alternately axially offset teeth with alternate teeth being positioned for alternate selective engagement with said first and second blocking gears and said releasing means including a detent mechanism engaging said locking gear and maintaining said locking gear in engagement with a selected one of said first and second blocking gears until a predetermined rotational force is transmitted to the locking gear through the restrained blocking gear whereupon said detent mechanism yields and the locking gear increments to its alternate position.

4. The apparatus of claim 3 which further includes a first unidirectional brake restricting said spool drive output of said first differential gear and retarding rotation of said first spool in the rotational direction opposite to the rotational direction imparted by said input drive source and a second unidirectional brake restricting said spool drive output of said second differential gear and operative to retard movement of said second spool in the rotational direction opposite to the rotational direction imparted by said input drive source so that when either said first or second spools serves as a web supply spool a restraining force is experienced by the supply spool by its respective brake.

5. The apparatus of claim 4 wherein said first unidirectional brake includes a first drum secured to the spool drive output of said first differential gear and a brake band positioned about said first drum and urged against said first drum by a biasing means and wherein said second unidirectional brake includes a second drum secured to the spool drive output of said second differential gear and a brake band positioned about said second drum and urged against said second drum by a biasing means.

6. The apparatus of claim 4 wherein said detent mechanism includes means for adjusting the amount of restraint exerted upon said locking gear, said detent adjusting means comprising a spring biased ball urged against said locking gear and positioned to lodge between adjacent teeth of said locking gear.

7. The apparatus of claim 2 wherein said restraining means includes a selectively positionable locking gear alternately engaging said blocking gears and a detent mechanism engaging said locking gear and restraining the rotation thereof and means for adjusting the amount of restraint exerted by said detent mechanism upon said locking gear.

8. The apparatus of claim 7 wherein said detent mechanism comprises a spring biased ball urged against said locking gear and positioned to lodge between adjacent teeth of said locking gear.

9. The apparatus of claim 8 which further includes a first unidirectional brake restricting said spool drive output of said first differential gear and retarding rotation of said first spool in the rotational direction opposite to the rotational direction imparted by said input drive source and a second unidirectional brake restricting said spool drive output of said second differential gear and operative to retard movement of said second spool in the rotational direction opposite to the rotational direction imparted by said input drive source so that when either of said first or second spools serves as a web supply spool a restraining force is experienced by the supply spool by its respective brake.

10. The apparatus of claim 2 wherein said spool drive output of said first differential gear includes a first spool drive output gear, said input of said first differential gear includes a wheel gear and a first pinion gear engaging said wheel gear and a second pinion gear engaging said first pinion gear and said first spool drive output gear, said first and second pinion gears being mounted upon said first blocking gear for rotation therewith so that when said first blocking gear is restrained rotational torque from said input drive source is transferred through said first and second pinion gears to said first spool drive output gear.

11. The apparatus of claim 10 wherein said spool drive output of said second differential gear includes a second spool drive output gear, said input of said second differential gear includes a second wheel gear, a third pinion gear engaging said second wheel gear and a fourth pinion gear engaging said third pinion gear and said second spool drive output gear, said third and fourth pinion gears being mounted upon said second blocking gear for rotation therewith.

12. The apparatus of claim 2 wherein said input of said first differential gear includes a first input bevel gear, a first idler bevel gear rotatably supported on said first blocking gear and engaging said first input bevel gear and said first spool drive output including a first spool drive bevel gear engaging said first idler gear so that when said first blocking gear is restrained, torque from said input drive source is transferred to said first spool drive bevel gear through said first idler bevel gear.

13. The apparatus of claim 12 wherein said input of said second differential gear includes a second input bevel gear, a second idler bevel gear rotatably supported on said second blocking gear and engaging said second input bevel gear and said second spool drive output including a second spool drive bevel gear engaging said second idler bevel gear so that when said second blocking gear is restrained, torque from said input drive source is transferred to said second spool drive bevel gear through said second idler bevel gear.

14. The apparatus of claim 2 wherein said input of said first differential gear includes a wheel gear and said first blocking gear having an opening, first and second meshed pinion gears positioned within said blocking gear opening and mounted for rotation about an axis parallel to the axis of rotation of said first blocking gear, said first pinion gear meshing with said input wheel gear and said second pinion gear driving said first spool drive output so that rotational torque imparted to said input wheel gear by said input drive source is transferred to said first spool drive output through said first and second pinion gears when the rotation of said first blocking gear is restrained.

15. The apparatus of claim 14 which further includes first and second cooperating pulleys coupled by a belt, said first pulley being driven by said first spool drive output and said second pulley being coupled to said second spool.

* * * * *